United States Patent [19]

Niederöst

[11] 4,315,594

[45] Feb. 16, 1982

[54] CONNECTION APPARATUS FOR A FIRE ALARM

[75] Inventor: Werner A. Niederöst, Schmerikon, Switzerland

[73] Assignee: Cerberus Ltd., Männedorf, Switzerland

[21] Appl. No.: 110,006

[22] Filed: Jan. 7, 1980

[30] Foreign Application Priority Data

Jan. 23, 1979 [CH] Switzerland ..... 695/79

[51] Int. Cl.[3] ..... G08B 17/00; H01R 13/50

[52] U.S. Cl. ..... 340/693; 339/186 M

[58] Field of Search ..... 339/186 R, 186 M, 188 R, 339/189 R, 190, 41, 88 R, 88 C, 21 R; 340/693

[56] References Cited

U.S. PATENT DOCUMENTS

| | | | |
|---|---|---|---|
| 1,495,701 | 5/1924 | McLean | 339/189 R |
| 2,446,971 | 8/1948 | Wittig | 339/189 R |
| 2,871,458 | 1/1959 | Rybold, Jr. | 339/189 R |
| 3,638,170 | 1/1972 | Clement et al. | 339/189 R |
| 3,945,702 | 3/1976 | Poliak et al. | 339/189 R |

*Primary Examiner*—Glen R. Swann, III

*Attorney, Agent, or Firm*—Werner W. Kleeman

[57] ABSTRACT

A connection apparatus for a fire alarm is composed of a socket portion intended to be secured in the space or area which is to be monitored and a fire alarm insert connectable by means of electrical and mechanical connection elements with the socket portion. At least three connection elements are arranged about the circumference of the socket portion. At the circumference of the side of the fire alarm insert confronting the socket portion there are provided contact springs. The connection elements and grooves come into engagement with one another in a certain manner. During a first partial rotation of the fire alarm insert there is established the mechanical connection. During a subsequent second partial rotation of the fire alarm insert, in the same direction as the first partial rotation, there is established the electrical connection.

9 Claims, 6 Drawing Figures

CONNECTION APPARATUS FOR A FIRE ALARM

BACKGROUND OF THE INVENTION

The present invention relates to a new and improved construction of connection apparatus for a fire alarm containing a socket portion or socket member intended to be secured in the space or area to be monitored and a fire alarm portion or insert connectible with the socket portion by means of electrical and mechanical connection elements.

The heretofore known fire alarms, constructed as ionization fire alarms, optical fire alarms or as heat sensitive fire alarms or the like, as a general rule comprise a socket portion mounted at the ceiling or wall of the room or the like which is to be monitored and a fire alarm insert which can be mounted at the socket portion. This fire alarm insert is either connected by means of fixed clamps or with the aid of a contact system in a pluggable fashion with the socket portion. Different constructional embodiments of such prior art fire alarms, particularly their connection devices, have been shown in FIGS. 1, 2 and 3 of the accompanying drawings, and equally, in Swiss Pat. No. 355,380 (corresponding to U.S. Pat. No. 2,963,600, Meili et al.), using a plug or pin connection in accordance with the principles of electronic tubes, in Swiss Patent No. 508,251 (corresponding to U.S. Pat. No. 3,767,917, Lampart et al.), utilizing a bayonet connection, in German Patent No. 2,539,655 (corresponding to GB-Pat. No. 1 518 056 GEBA), using a central bayonet connection, and German Petty Patent No. 78 23178.4, using a rotationally symmetrical plug connection.

These heretofore known fire alarms are afflicted with the drawback that the servicing or maintenance personnel are confronted with extremely great difficulties as far as the maintenance and care of the fire alarms is concerned, which sometimes are mounted at difficultly accessible places. With some constructions of the state-of-the-art fire alarms it is necessary for the servicing personnel to climb upon a ladder, in order to retrieve the fire alarm from the ceiling of the room to be monitored. With other designs of prior art fire alarms the fire alarm inserts are constructed such that they can so-to-speak be "picked-off" the ceiling of the room by means of a tool mounted at a long rod or the like. The insertion of new or reconstructed fire alarm inserts in the fire alarm socket is accomplished in the same manner. What is disadvantageous with this technique is that the fire alarms frequently do not possess the correct mechanical or also electrical connection contacts. In practical terms, this means that when an alarm should be reported there has been mounted a functionally inoperative fire alarm. The quality and reliability of the mechanical and electrical connection elements is of decisive importance.

All of the heretofore known connection systems could not operate completely satisfactorily. Although it was possible to improve upon individual drawbacks of existing constructions, nonetheless in doing so it was necessary to again accept other drawbacks. In particular, corrosion problems arose during the course of the service time of a fire alarm, which not only markedly impairs or endangers the electrical contact, but also the mechanical connection elements.

Frequently, the fire alarms are in service in the presence of extremely rough ambient conditions; they are exposed to corrosive vapors, high moisture, dust deposition or the like, by way of example. Also, frequent faulty functionality of the fire alarms arises due to mechanical damage of the contact springs by the service or maintenance personnel. The heretofore known fire alarms attempt to take into account this problem in that the movable part of the electrical contact system, such as the contact spring 1 of the arrangement of FIG. 1 is arranged in the socket portion 4 and the rigid part 2 of the electrical contact system is arranged in the fire alarm insert. There are also known to the art fire alarms wherein the arrangement of the movable part and the rigid part of the electrical contact system is reversed, or where both in the socket portion and also in the fire alarm insert there are used resilient parts of the electrical contact system. If the resilient part is located at the fire alarm insert 3, as shown for the prior art arrangements of FIGS. 2 and 3, then the fire alarm can be examined visually by the service personnel for corrosion damage. However, in this case there exists the danger that during the revision work the contact springs 1 will become bent, leading to impairment in the functionality of the fire alarm.

Therefore, there have been proposed fire alarms wherein the contact springs 1 are arranged in the socket portion 4 of the fire alarm. With this proposal as shown in FIG. 1 there is however the drawback that the socket member, during the servicing operation, is not as readily accessible as the fire alarm insert and that corrosion phenomenon at the fire alarm-socket member go unnoticed.

SUMMARY OF THE INVENTION

Therefore, with the foregoing in mind it is a primary object of the present invention to provide a new and improved construction of fire alarm which is not afflicted with the aforementioned drawbacks and limitations of the prior art constructions heretofore discussed.

Another and more specific object of the present invention aims at providing a new and improved construction of fire alarm which overcomes the disadvantages of the state-of-the-art fire alarms, in other words, specifically providing a novel connection apparatus of the previously mentioned type which enables removing, by very simple means, the fire alarm insert out of the socket portion, and further, wherein the electrical contacts are protected against unintentional contact by the servicing or maintenance personnel or other individuals coming into contact with the fire alarm and the electrical contact surfaces between the socket portion and the fire alarm insert are arranged parallel to the axis of the entire fire alarm unit.

Now in order to implement these and still further objects of the invention, which will become more readily apparent as the description proceeds, the connection apparatus for a fire alarm, as contemplated by the present development, is manifested by the features of an arrangement of at least three connection elements at the circumference of the socket portion and grooves having contact springs arranged around the circumference of the side of the fire alarm insert confronting the socket portion. The connection elements and the grooves engage with one another such that during a first partial rotation of the fire alarm insert there is established the mechanical connection and during a subsequent, second partial rotation of the fire insert, in the same rotational sense, there is established the electrical connection.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
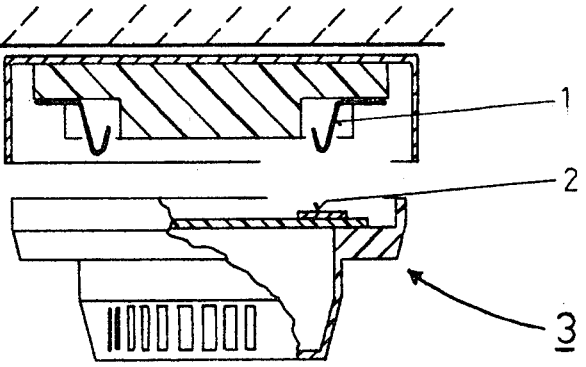
Fig 1 PRIOR ART
FIGS. 1, 2 and 3 are respective exploded sectional views of prior art constructions of fire alarms of the type specifically referred to at the introductory portion of this disclosure.
Figure 2:
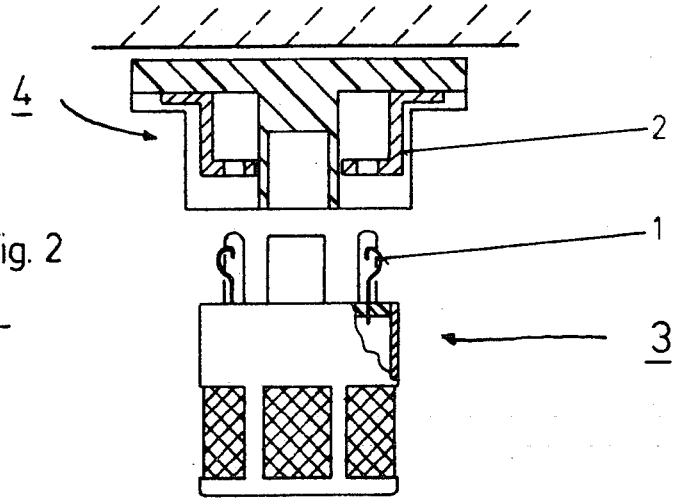
Fig. 2 PRIOR ART
Figure 3:
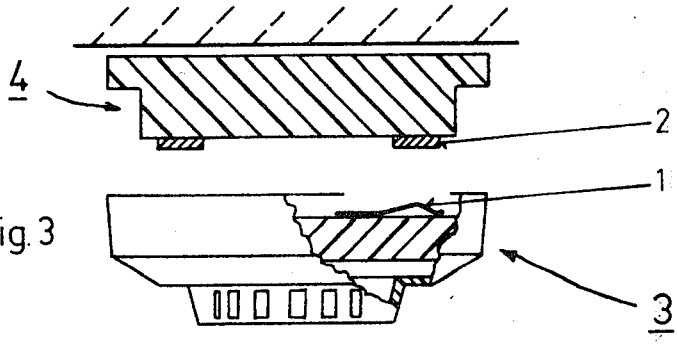
Fig. 3 PRIOR ART
Figure 4:
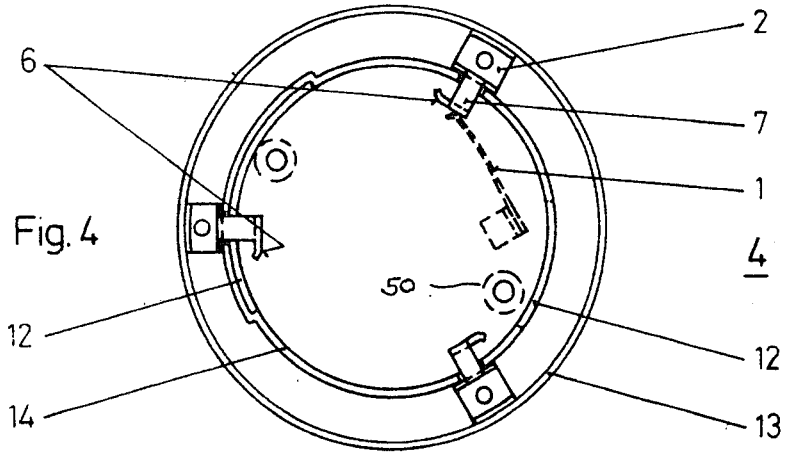
FIG. 4 is a schematic top plan view of the socket portion of a fire alarm according to the invention.

Describing now the drawings, and keeping in mind the comments and observations made with respect to the prior art constructions of fire alarms previously considered with regard to FIGS. 1, 2 and 3, in FIG. 4 there is shown in top plan view the socket portion of socket 4 of a fire alarm designed according to the invention. At the circumference of the socket portion 4 there are attached in any suitable fashion three connection elements 2. These connection elements 2 enclose an angle of about 120° with respect to one another. Of course, a different number of connection elements 2 could be provided, such as four or more such connection elements 2 which are then arranged in distributed fashion about the periphery or circumference of the socket portion 4. The distribution of the connection elements 2 need not be equidistant, as for instance has been shown purely by way of example and illustration for the connection elements 2 in FIG. 4. Each connection element 2 has a substantially L-shaped bracket-like or equivalent flexed configuration. Its bracket part 7, arranged radially with respect to the lengthwise axis of the socket portion 4, carries the contact surfaces 6 against which come to bear the contact springs 1 arranged in the fire alarm insert 3. This has been indicated in broken lines in FIG. 4 and will be still further explained hereinafter based upon the illustration of FIG. 6. At the floor or base of the socket portion 4 there are provided attachment or connection holes, generally indicated by reference character 50 and shown in broken lines in FIG. 4. They serve for attachment of the socket portion 4 at the ceiling or at a wall of the room or other area which is to be supervised. As shown in the drawings, the connection elements 2 are arranged between the outer edge 13 and the inner edge 14 of the socket portion or member 4. Both of these edges 13 and 14 are integrated with the base or floor of the socket portion 4. The inner edge or skirt 14 contains recesses 12 constituting part of the mechanical coding device or key. This coding or key device insures that the fire alarm insert 3 and the socket portion 4 always will come into engagement in the correct position with one another. Consequently, there is prevented any false electrical contact, which otherwise could damage not only the electrical devices of the fire alarm but also those of the central signal station.

Figure 5:
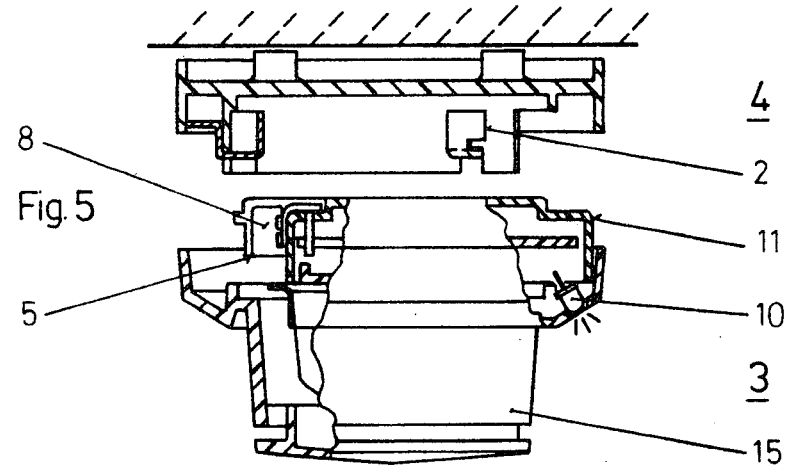
FIG. 5 is a partial sectional view, in exploded illustration, of the socket portion and the fire alarm insert of the fire alarm according to the invention.

FIG. 5 shows in an exploded sectional view the socket portion 4 which is attached at the ceiling or the wall, as the case may be, of the room or space to be monitored. The individual parts have been conveniently designated with the same characters as described above in conjunction with FIG. 4. Further, FIG. 5 shows in partial sectional view the fire alarm insert 3. As will be seen, the fire alarm insert 3 contains within its housing 15 the actual fire alarm portion, which however has not been here further illustrated since the same in unimportant for understanding the subject matter of the instant invention, and furthermore, it is to be expressly understood that various prior art constructions of a fire alarm proper could be used in the fire alarm insert 3. At the upper portion of the fire alarm insert 3 there are located grooves 8 (or equivalent structures) which are present in the same number and in the same distribution about the circumference thereof as there are provided connection elements 2 at the socket portion 4. Furthermore, the upper portion of the fire alarm insert 3 contains a part 11 of the mechanical coding device which in conjunction with the recesses 12 (FIG. 4) forms the code. The outer wall of the grooves 8 has an edge 5 which, in coaction with the radial part 7 of the connection element 2, produces the mechanical connection between the fire alarm insert 3 and the socket portion 4. In FIG. 5 there is illustrated an alarm indicator 10 in the fire alarm insert 3. This alarm indicator 10 may for instance be of the type which lights-up when the fire alarm has responded. According to the embodiments of FIGS. 5 and 6 this alarm indicator 10 constitutes part of the mechanical coding device.

According to a different embodiment the inner edge of the groove 8 is constructed such that in the work or operable position there is only present a small gap between the contact spring 1 and the inner edge of the groove 8, this gap being structured such that the contact spring 1 flatly bears against the inner edge when there acts upon the contact spring 1, from the outside a radially directed force, without there occurring, in the work position, any contact between the contact spring 1 and the inner edge of the groove 8. In this way there is assured the result that with unintentional contact of the contact springs 1 by some tool, such as, say, for instance a screwdriver, there can be avoided plastic deformation of the electrical contact springs 1.

Figure 6:
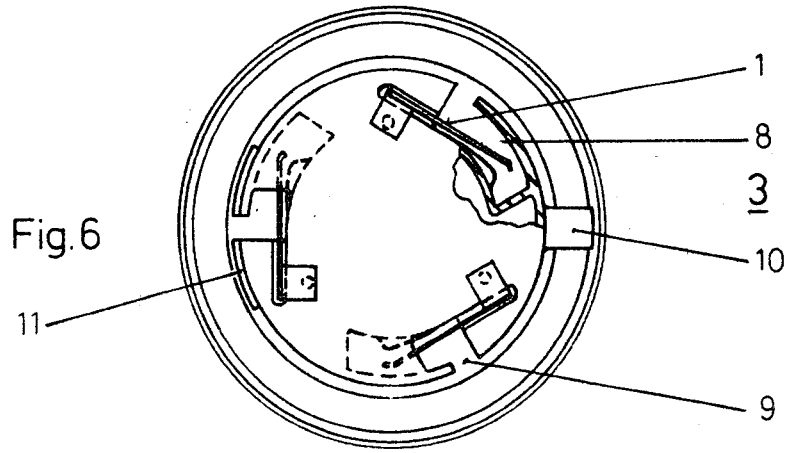
FIG. 6 is a top plan view of the fire alarm insert of the inventive fire alarm.

Finally, FIG. 6 shows in top plan view, partially in section, the side of the fire alarm insert 3 which confronts the socket portion 4 and comes into engagement therewith. The contact springs 1 are arranged in the grooves 8. These grooves 8 have an outer wall which is forwardly drawn to such an extent that only a very small opening 9 produces towards the outside the connection. Reference character 11 designates the part of the mechanical coding device which has already been discussed in detail in conjunction with FIG. 5.

While there are shown and described present preferred embodiments of the invention, it is to be distinctly understood that the invention is not limited thereto, but may be otherwise variously embodied and practiced within the scope of the following claims.

ACCORDINGLY,

What I claim is:

1. A connection apparatus for a fire alarm containing a socket portion intended to be secured to a room which is to be supervised and a fire alarm insert which can be connected with the socket portion by electrical and mechanical connection elements, the improvement which comprises:

an arrangement of at least three connection elements around the periphery of the socket portion;

an arrangement of contact springs, said contact springs being arranged in grooves arranged around the periphery of a side of the fire alarm insert confronting the socket portion;

said connection elements and said grooves coming into engagement with one another such that during a first partial rotation of the fire alarm insert there is established the mechanical connection and during a subsequent second partial rotation of the fire alarm insert, in the same directional sense, there is established the electrical connection.

2. The connection apparatus as defined in claim 1, wherein:

each connection element comprises a substantially L-shaped bracket element;

each said connection element having a portion arranged radially with respect to the lengthwise axis of the socket portion and, following the first partial rotation of the fire alarm insert, producing in conjunction with an edge of a predetermined one of said grooves cooperating with said connection element the mechanical connection between the fire alarm insert and the socket portion;

each such connection element having a contact surface which, after accomplishing the second partial rotation forms together with a predetermined one of said contact springs cooperating with said connection element the electrical connection between the fire alarm insert and the socket portion.

3. The connection apparatus as defined in claim 1, wherein:

each groove arranged around the periphery of the fire alarm insert has an opening in a groove wall, said opening being essentially parallel to the lengthwise axis of the fire alarm insert;

said opening enabling the passage of a predetermined one of said connection elements; and said groove wall being formed such that the contact spring is covered and protected against contact from the outside.

4. The connection apparatus as defined in claim 1, further including:

a mechanical key means for preventing false electrical connections.

5. The connection apparatus as defined in claim 4, wherein:

said key means comprises projection means and recess means engaging with one another.

6. The connection apparatus as defined in claim 3, wherein:

said fire alarm insert is provided with an alarm indicator means arranged at the periphery of the fire alarm insert such that it bisects the angle between two of said openings.

7. The connection apparatus as defined in claim 6, wherein:

said alarm indicator means constitutes part of a mechanical key means for preventing false electrical connections.

8. The connection apparatus as defined in claim 3, wherein:

each groove has an inner edge formed such that upon insertion of the fire alarm insert into the socket portion there remains a narrow gap between the contact spring and the inner edge; and said contact spring bears flatly against the inner edge upon application of a radial force.

9. The connection apparatus as defined in claim 3, wherein:

each connection element comprises a substantially L-shaped bracket element;

each said connection element having a portion arranged radially with respect to the lengthwise axis of the socket portion and, following the first partial rotation of the fire alarm insert, producing in conjunction with an edge of a predetermined one of said grooves cooperating with said connection element the mechanical connection between the fire alarm insert and the socket portion;

each such connection element having a contact surface which, after accomplishing the second partial rotation forms together with a predetermined one of said contact springs cooperating with said connection element the electrical connection between the fire alarm insert and the socket portion;

the outer wall of the groove being forwardly drawn to such an extent that the remaining opening is not larger than needed for the passage of the radially arranged part.

* * * * *